US007085514B2

(12) United States Patent
Kaneko

(10) Patent No.: US 7,085,514 B2
(45) Date of Patent: Aug. 1, 2006

(54) CLEANING DEVICE AND IMAGE FORMING APPARATUS EQUIPPED WITH THE SAME

(75) Inventor: Chiemi Kaneko, Toride (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 10/865,747

(22) Filed: Jun. 14, 2004

(65) Prior Publication Data

US 2005/0025533 A1 Feb. 3, 2005

(30) Foreign Application Priority Data

Jul. 28, 2003 (JP) ..... 2003-202562

(51) Int. Cl.
*G03G 15/16* (2006.01)
*G03G 15/20* (2006.01)

(52) U.S. Cl. ..... 399/101; 399/309

(58) Field of Classification Search ..... 399/101, 399/297, 309
See application file for complete search history.

(56) References Cited

U.S. PATENT DOCUMENTS 6,173,148 B1 1/2001 Matsuda et al.
6,311,031 B1 * 10/2001 Hirano ..... 399/101
6,347,214 B1 2/2002 Kaneko
6,584,295 B1 * 6/2003 Omata et al. ..... 399/309 X
6,643,489 B1 11/2003 Omata et al.
6,728,505 B1 4/2004 Omata et al.
2002/0122679 A1 * 9/2002 Omata et al. ..... 399/309
2003/0016970 A1 * 1/2003 Omata et al. ..... 399/309 X

FOREIGN PATENT DOCUMENTS

JP 2003-50514 2/2003
JP 2003-57971 2/2003

* cited by examiner

*Primary Examiner*—Sandra L. Brase
(74) *Attorney, Agent, or Firm*—Oblon, Spivak, McClelland, Maier & Neustadt, P.C.

(57) ABSTRACT

Disclosed is an image forming apparatus capable of elongating the service life of an intermediate transfer belt and of performing cleaning on the intermediate transfer belt in a satisfactory manner. To remove any residual toner on a second intermediate transfer belt, a cleaning blade is brought into contact with the second intermediate transfer belt, and a voltage is applied to the cleaning blade to thereby remove the residual toner and paper powder. In the case of one-side copying and when no residual toner exists on the second intermediate transfer belt, the cleaning blade is brought into contact with the second intermediate transfer belt to thereby remove paper powder.

8 Claims, 2 Drawing Sheets

CLEANING DEVICE AND IMAGE FORMING APPARATUS EQUIPPED WITH THE SAME

BACKGROUND OF THE INVENTION

1. Field of the Invention

The present invention relates to a cleaning device for cleaning an intermediate transfer member and to an image forming apparatus equipped with the cleaning device.

2. Description of the Background Art

Conventionally, a color image forming apparatus has been known which adopts a one-path two-side transfer system. In such a color image forming apparatus, which adopts the one-path two-side transfer system, a part of a first intermediate transfer belt and a part of a second intermediate transfer belt are opposed to each other with a transfer sheet therebetween. Due to this arrangement, a toner image formed on the first intermediate transfer belt by means of a photosensitive member is transferred to the front surface of the transfer sheet. At the same time, a toner image transferred in advance to the second intermediate transfer belt by way of the first intermediate transfer belt is transferred to the back surface of the recording medium. In this way, by transporting the transfer sheet only one time, it is possible to transfer synthetic toner images to both sides of the transfer sheet. Any residual toner not transferred to the transfer sheet but remaining on the intermediate transfer belts is removed by cleaning means respectively provided for the intermediate transfer belts.

When an image is to be transferred to one side of a transfer sheet, a toner image is formed solely on the first intermediate transfer belt, and this toner image is transferred to one side of the transfer sheet. By means of a cleaning blade serving as a cleaning means for cleaning the first intermediate transfer belt, any residual toner on the first intermediate transfer belt is removed, and a cleaning blade for cleaning the second intermediate transfer belt removes any paper powder adhering to the second intermediate transfer belt. Residual toner on an intermediate transfer belt is electrostatically attracted onto the intermediate transfer belt, so that it cannot be completely removed just by bringing a cleaning blade into contact with the intermediate transfer belt.

Thus, a powerful cleaning means is needed. For example, it is necessary to apply a voltage to the cleaning blade, etc. to generate an electric field, and to reduce, by the action of this electric field, the electrostatic attracting force acting on the residual toner on the intermediate transfer belt, performing cleaning with the cleaning blade in this state.

In contrast, when the transfer of an image is to be performed solely to one side of a transfer sheet, the cleaning to be performed on the second intermediate belt solely involves the removal of paper powder; by bringing the cleaning blade into contact with the second intermediate transfer belt, the removal of paper powder is possible without involving any load on the second intermediate transfer belt.

In the prior-art technique, however, even when image transfer is to be effected only on one side of the transfer sheet, a powerful cleaning means suitable for the removal of residual toner is used as the cleaning means for the second intermediate transfer belt. The use of a cleaning means more powerful than necessary results in an unnecessary load on the second intermediate transfer belt, which may lead, in some cases, to a reduction in the service life of the intermediate transfer belt. On the other hand, if, to reduce the load on the intermediate transfer belt, a cleaning means with weak cleaning power is used, the residual toner cannot be completely removed, so that there is a fear of the cleaning being rather insufficient.

SUMMARY OF THE INVENTION

The present invention has been made in view of the above problem in the prior art. It is an object of the present invention to provide a cleaning device capable of achieving an increase in the service life of an intermediate transfer belt and of performing the cleaning of the intermediate transfer belt in a satisfactory manner, and an image forming apparatus equipped with such a cleaning device.

In accordance with the present invention, there is provided a cleaning device for cleaning a second intermediate transfer member for use with an image forming apparatus. The image forming apparatus comprises an image bearing member, a first intermediate transfer member and the second intermediate transfer member whose surfaces are held in contact with each other and caused to make an endless movement while forming a nip therebetween, and a transfer device which transfers toner images to both sides of the recording medium by, in a process of transporting a recording medium held by the nip toward a downstream side of the nip with respect to a direction of the endless movement of the surfaces of the first and second intermediate transfer members, transferring a first toner image, which has been transferred in advance from the image bearing member to the second intermediate transfer member by way of the first intermediate transfer member, to a first surface of the recording medium, and transferring, at the same time, a second toner image, which has been transferred in advance from the image bearing member to the first intermediate transfer member, to a second surface of the recording medium. The cleaning device comprises a plurality of cleaning means for cleaning the second intermediate transfer member.

In accordance with the present invention, there is also provided a cleaning device for cleaning a second intermediate transfer member for use with an image forming apparatus. The image forming apparatus comprises an image bearing member, a first intermediate transfer member and the second intermediate transfer member whose surfaces are held in contact with each other and caused to make an endless movement while forming a nip therebetween, and a transfer device which transfers toner images to both sides of the recording medium by, in a process of transporting a recording medium held by the nip toward a downstream side of the nip with respect to a direction of the endless movement of the surfaces of the first and second intermediate transfer members, transferring a first toner image, which has been transferred in advance from the image bearing member to the second intermediate transfer member by way of the first intermediate transfer member, to a first surface of the recording medium, and transferring, at the same time, a second toner image, which has been transferred in advance from the image bearing member to the first intermediate transfer member, to a second surface of the recording medium. The cleaning device comprises a plurality of cleaning means for cleaning the second intermediate transfer member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The present invention will now be described in detail.

First, an image forming apparatus according to an embodiment of the present invention will be described.

Figure 1:
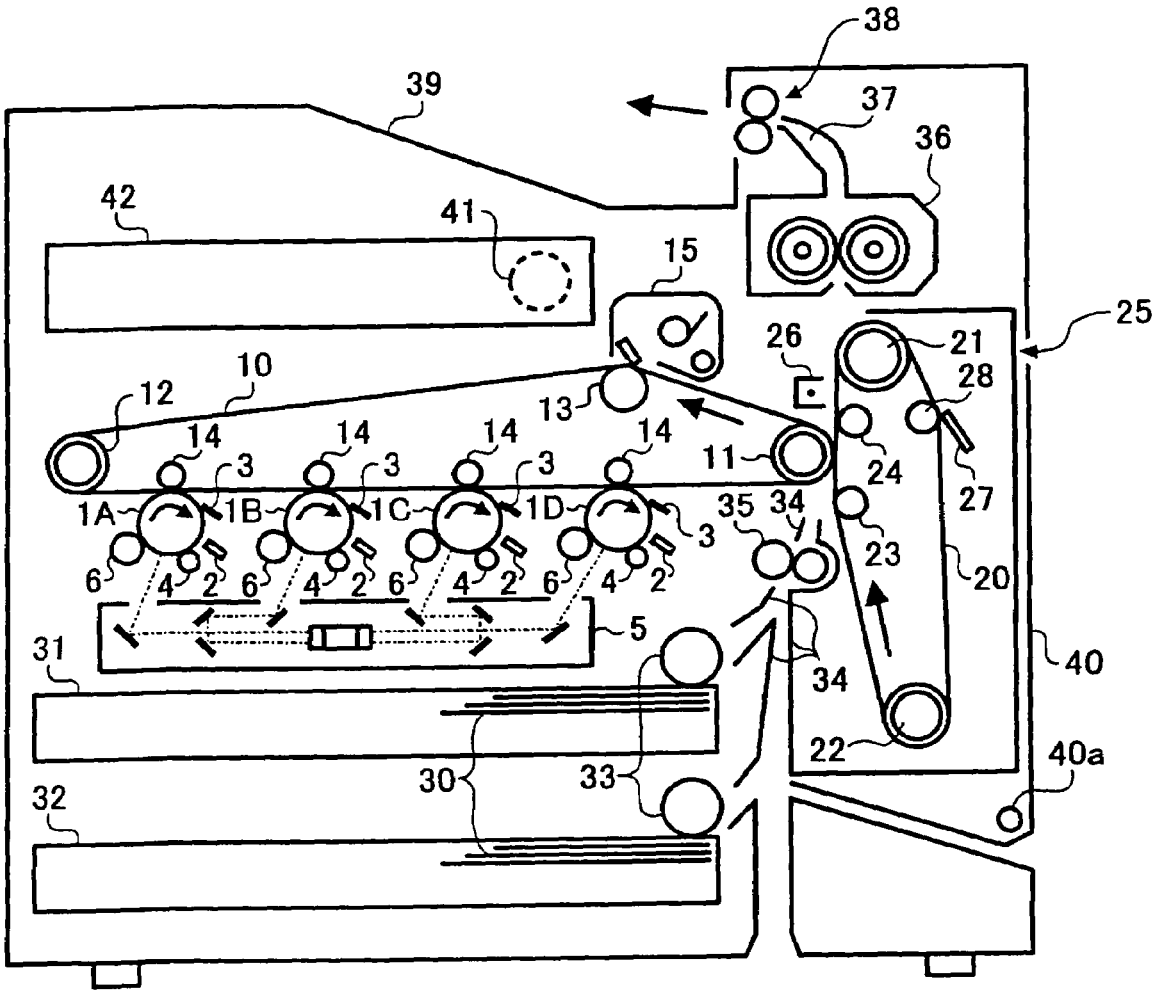
FIG. 1 is an explanatory view schematically showing the construction of a main portion of an image forming apparatus according to an embodiment of the present invention.

FIG. 1 is a schematic diagram showing the construction of a so-called one-path transport type two-side image forming apparatus according to this embodiment, which is capable of forming images substantially simultaneously on both sides of a recording medium. As shown in FIG. 1, in this image forming apparatus, there are arranged, at the center as seen in the drawing, drum-like photosensitive members 1 (1A, 1B, 1C, and 1D) serving as first image bearing members so as to be capable of rotating in the direction of the arrows. Around each of these photosensitive members 1, there are arranged a charge eliminating device 2 for eliminating charge on the surface of the photosensitive member 1, a cleaning device 3 for cleaning the surface of the photosensitive member 1, and a charging device 4 for uniformly charging the surface of the photosensitive member 1. Further, around each photosensitive member 1, there are arranged an exposure device 5 for forming an electrostatic latent image in the charged portion of the photosensitive member 1 through optical writing with a laser beam, and a developing device 6 for developing the electrostatic latent image thus formed.

This image forming apparatus adopts a so-called tandem system using four photosensitive members 1, with the components provided around each photosensitive member 1 for forming the image being the same. (In the following the same components are indicated by the same reference numerals, and a description thereof will be omitted). Further, the developing devices 6 use color materials (toners) of different colors.

In this embodiment, it is also possible to adopt belt-like photosensitive members instead of the drum-like photosensitive members; further, instead of the exposure device 5 using the well-known laser system, it is also possible to adopt an exposure device composed of LED arrays and image formation means.

Above the photosensitive members 1, a first intermediate transfer belt 10 in the form of an endless belt serving as a second image bearing member is supported and stretched between rotating rollers 11, 12, and 13 so as to be run in the direction of the arrow in FIG. 1. On the inner side of this first intermediate transfer belt 10, transfer rollers 14 serving as a first transfer means are arranged so as to be opposed to the photosensitive members 1. Further, on the outer side of the first intermediate transfer belt 10, there is arranged a second-image-bearing-member cleaning device 15 for cleaning the surface of the first intermediate transfer belt 10, which serves as the second image bearing member. Provided inside the cleaning device 15 are a well-known brush roller, a recovery roller, a blade, etc., which are adapted to remove residual toner and paper powder remaining on the surface of the first intermediate transfer belt 10.

On the right-hand side, as seen in the drawing, of the first intermediate transfer belt 10, a second intermediate transfer belt 20 in the form of an endless belt serving as a third image bearing member is supported and stretched between a rotating driving roller 21 and rollers 22 and 23 so as to be run in the direction indicated by the arrow. On the inner side of the second intermediate transfer belt 20, there is arranged a transfer roller 24 serving as a second transfer means. Further, on the outer side of the second intermediate transfer belt 20, there are arranged a second cleaning device 25 for cleaning the surface of the second intermediate transfer belt 20, a charger 26 serving as a third transfer means, etc. The first intermediate transfer belt 10 and the second intermediate transfer belt 20 are held in contact with each other while forming a predetermined transfer nip by means of the roller 11, the transfer roller 24, and the roller 23.

Sheets 30 serving as recording mediums are accommodated in sheet feeding cassettes 31 and 32 arranged in the lower portion of the apparatus as seen in the drawing. Starting with the uppermost ones, the sheets 30 are transported one by one by sheet feeding rollers 33 to a registration roller pair 35 by way of a plurality of guides 34. In the upper apparatus portion as seen in the drawing, there are arranged a fixing-heating means 36 for fixing a toner image transferred to the sheet 30 to that sheet, a sheet delivery guide pair 37, a sheet delivery roller pair 38, and a delivery sheet stacking portion 39, forming a sheet transport path extending from the registration roller pair 35. A frame 40 constituting a part of the apparatus main body can be rotated and opened around an axle 40A, so that the transport path for the sheets 30 can be opened wide, thus facilitating the clearing of jammed sheets 30.

Further, above the first intermediate transfer belt 10 and below the delivery sheet stacking portion 39, there is arranged a supply toner containing portion 42 containing toner cartridges 41 containing toners of four colors of magenta, cyan, yellow, and black. The supply toner containing portion 42 supplies as appropriate each developing device 6 with a toner of a predetermined, corresponding color by a powder pump or the like (not shown).

Next, the operation of forming images on both sides of the sheet 30 by the above-described image forming apparatus will be described.

First, the surfaces of the photosensitive members 1A, 1B, 1C, and 1D are uniformly charged by the charging device 4. Then, by operating the exposure device 5, optically modulated laser beams are emitted in correspondence with image signals (information corresponding to the colors), and optical writing with these beams is effected on the uniformly charged surfaces of the photosensitive members 1A, 1B, 1C, and 1D to thereby form electrostatic latent images. The electrostatic latent images on the photosensitive members 1A, 1B, 1C, and 1D are developed by the developing devices 6, and visualized toner images are formed and retained on the surfaces of the photosensitive members 1A, 1B, 1C, and 1D.

The toner image on the photosensitive member 1A is transferred by the transfer roller 14 to the surface of the first intermediate transfer belt 10 moving in synchronism with the photosensitive member 1A. The first intermediate transfer belt 10 moves by a predetermined distance in the direction of the arrow while bearing the toner image from the photosensitive member 1A transferred to the surface of the first intermediate transfer belt 10. Subsequently, the toner image formed on the photosensitive member 1B is transferred to the first intermediate transfer belt 10 so as to be superimposed on the toner image formed on the photosensitive member 1A already borne by the first intermediate transfer belt 10. Similarly, the toner images formed on the photosensitive members 1C and 1D are transferred to the first intermediate transfer belt 10 so as to be superimposed on the toner images of the other colors already borne by the first intermediate transfer belt 10. Eventually, there is formed a superimposed image in four colors on the first intermediate transfer belt 10. The residual toner remaining on the surfaces of the photosensitive members 1A, 1B, 1C, and 1D after the transfer is removed by the cleaning devices 3, and the charge on them is eliminated by the charge eliminating devices 2 to make the apparatus ready for the next image forming cycle. In synchronism with this, the second intermediate transfer belt 20 moves in the direction of the arrow, and the toner image formed on the surface of the first intermediate transfer belt 10 is transferred to the surface of the second intermediate transfer belt 20 by the action of the transfer roller 24.

In this image forming apparatus, a so-called tandem system is adopted, and image formation is conducted by moving the first and second intermediate transfer belts 10 and 20 while effecting image formation on the four photosensitive members 1A, 1B, 1C, and 1D, so that it is possible to reduce the requisite time for image formation.

When the four-color superimposed image on the first intermediate transfer belt 10 has been transferred to the second intermediate transfer belt 20, and the first intermediate transfer belt 10 has moved to a predetermined position, a toner image to be formed on the other side of the sheet 30 is formed through image formation on the photosensitive members 1 by a process similar to the one as described above. Then, the toner image on the photosensitive members 1 is transferred to the first intermediate transfer belt 10 by the transfer rollers 14. In synchronism with this, in the sheet feeding cassette 31 or the sheet feeding cassette 32, the uppermost sheet 30 is drawn out by the sheet feeding roller 33 rotating counterclockwise, and is transported to the registration roller pair 35, thus starting sheet feeding.

The sheet 30 having passed the registration roller pair 35 is sent to the gap between the first intermediate transfer belt 10 and the second intermediate transfer belt 20, and the toner image on the surface of the first intermediate transfer belt 10 is transferred to one side of the sheet 30 by the transfer roller 24. The sheet 30, to which the toner image on the surface of the first intermediate transfer belt 10 has been transferred, is further transported upwards, and the toner image on the surface of the second intermediate transfer belt 20 is transferred to the other side of the sheet 30 by the charger 26. In effecting the transfer, the transport of the sheet 30 is timed such that the image position is normal.

The sheet 30, to which toner images have been transferred to both sides thereof by the above-described step, is sent to the fixing means 36, and the toner images on both sides of the sheet 30 are simultaneously melted and fixed to the sheet, the sheet being transported by the sheet delivery roller pair 38 by way of the guide pair 37 to be delivered onto the delivery sheet stacking portion 39 in the upper portion of the main body frame.

In the case in which the delivery sheet stacking portion 39 is formed as shown in FIG. 1, the sheet 30 is placed on the delivery sheet stacking portion 39 such that the side (page) of the sheet 30 with the image first transferred to the sheet 30, that is, the side to which transfer has been directly effected from the first intermediate transfer belt 10 to the sheet 30, faces downwards. Thus, for page collation, the toner image of the second page is first formed on the photosensitive members 1, and that toner image is retained on the second intermediate transfer belt 20, the image of the first page being directly transferred from the first intermediate transfer belt 10 to the sheet 30. Exposure is effected such that the image to be transferred from the first intermediate transfer belt 10 to the sheet 30 is in the form of erect images on the surfaces of the photosensitive members 1 and that the toner image to be transferred from the second intermediate transfer belt 20 to the sheet 30 is in the form of inverted images (mirror images) on the surfaces of the photosensitive members 1. This order in image formation for page collation can be realized by a well-known technique for storing image data in memory, and the exposure in which switching to an erect or an inverted (mirror) image is effected can be realized by a well-known image processing technique.

In the above-described image forming operation, image formation is effected on both sides of the sheet 30; when effecting image formation solely on one side of the sheet 30, two methods are available: a method in which a toner image on the second intermediate transfer belt 20 is transferred to the sheet 30, and a method in which the process of transferring toner to the second intermediate transfer belt 20 is omitted and in which transfer to the sheet 30 is effected while transferring toner images formed on the surfaces of the photosensitive members 1 to the first intermediate transfer belt 10. In the following, the latter method will be described.

In this case, the sheet 30 is sent to the gap between the first intermediate transfer belt 10 and the second intermediate transfer belt 20 in synchronism with the toner image formed on the first intermediate transfer belt 10 for positional alignment, and the toner image on the first intermediate transfer belt 10 is transferred to the sheet 30 by the transfer roller 24. At this time, the charger 26 does not operate, and the sheet 30 moves with the second intermediate transfer belt 20 to be fed to the region where the fixing means 36 is provided to fix the toner to the sheet. Thereafter, the sheet 30 is detached from the second intermediate transfer belt 20, and is delivered by the sheet delivery roller pair 38 by way of the guide pair 37 onto the delivery sheet stacking portion 39, with the image surface facing downward (face down). In this arrangement, even if a document with several pages is processed successively starting with the first page, the printed sheets are in order when extracted from the delivery sheet stacking portion 39.

In the following, the cleaning device 25 featuring this embodiment will be described.

Figure 2:
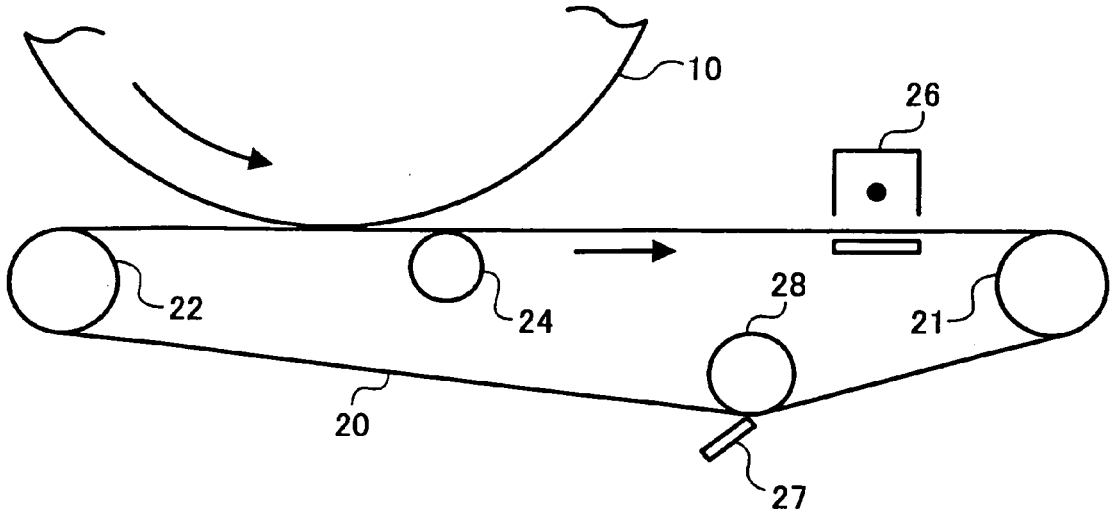
FIG. 2 is a schematic diagram showing the construction of a second intermediate transfer belt of the image forming apparatus.

FIG. 2 schematically shows the construction of the second intermediate transfer belt 20. As shown in FIG. 2, as the second cleaning device 25 serving as the cleaning means for the second intermediate transfer belt 20, there is provided a cleaning blade 27. This cleaning blade 27 has an attachment/detachment mechanism (not shown), making it possible for the blade to be brought into contact with and separated from the second intermediate transfer belt 20. Further, there is arranged a tension roller 28 as an opposing member opposing the cleaning blade 27 with the second intermediate transfer belt 20 being therebetween. Further, the cleaning blade 27 is formed of a conductive material, and voltage is applied to the cleaning blade 27 from a power source device (not shown).

Next, the operation of the cleaning blade 27 when a toner image is transferred to the second intermediate transfer belt 20 will be described. A toner image transferred from the first intermediate transfer belt 10 to the second intermediate transfer belt 20 is transferred to a transfer sheet by the charger 26. To remove any residual toner remaining on the second intermediate transfer belt 20, the cleaning blade 27 is brought into contact with the second intermediate transfer belt 20. At this time, there is applied a voltage generating an electric field between the tension roller 28 and the cleaning blade 27. More specifically, a voltage of a polarity opposite to that of the toner is applied from a power source device (not shown) to the cleaning blade 27, and an electric field is generated between the tension roller 28, which is grounded, and the cleaning blade 27. Due to the action of this electric field, the electrostatic attraction force between the second intermediate transfer belt 20 and the residual toner thereon is reduced, and, in this state, cleaning is effected by the cleaning blade 27.

Next, the operation of the cleaning blade 27 when copying is effected solely on one side of a transfer sheet and there is no toner image on the second intermediate transfer belt 20 will be described. The toner image formed on the first intermediate transfer belt 10 is transferred to the transfer sheet. At this time, some paper powder from the transfer sheet adheres to the second intermediate transfer belt 20. To remove this paper powder, the cleaning blade 27 is brought into contact with the second intermediate transfer belt 20, and the paper powder on the second intermediate transfer belt 20 is thereby removed. At this time, the paper powder is removed without applying any voltage to the cleaning blade 27 from the power source device.

Next, a modification of this embodiment will be described.

Figure 3:
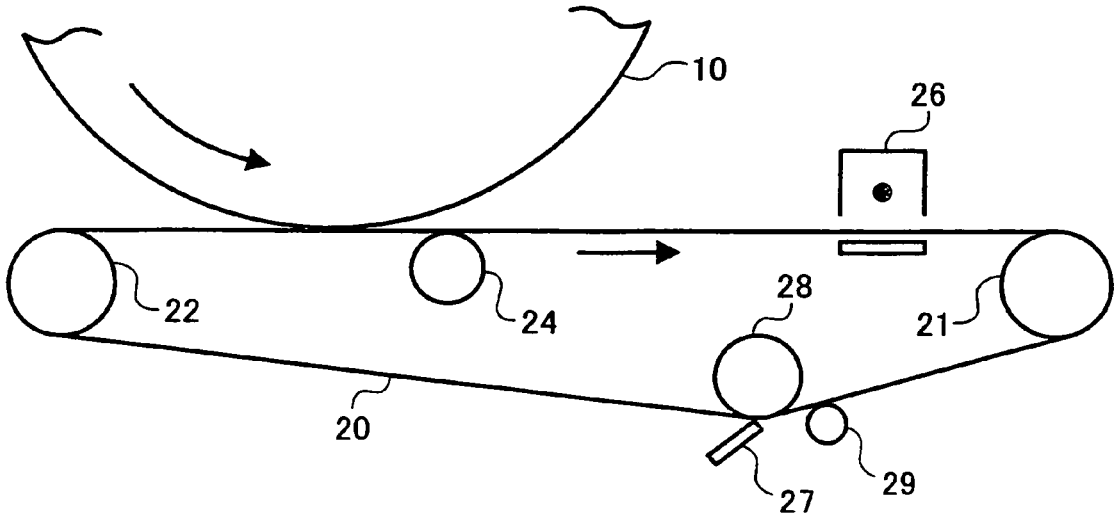
FIG. 3 is a schematic diagram showing the construction of a modification of the embodiment.

FIG. 3 schematically shows the construction of this modification. The cleaning device 25 shown in FIG. 3 is equipped with two cleaning members: the cleaning blade 27 and a cleaning roller 29. The cleaning blade 27 and the cleaning roller 29 are respectively equipped with attachment/detachment mechanisms (not shown), making them capable of being brought into contact with and separated from the second intermediate transfer belt 20. Further, there is provided the tension roller 28 as the opposing member opposed to the cleaning blade 27 through the intermediation of the second intermediate transfer belt 20. A voltage is applied to the cleaning roller 29 from a power source device (not shown).

When cleaning is to be performed on any residual toner on the second intermediate transfer belt 20, the cleaning blade 27 and the cleaning roller 29 are brought into contact with the second intermediate transfer belt 20. Then, a voltage of a polarity opposite to that of the toner is applied to the cleaning roller 29 from a power source device (not shown) to generate an electric field between the tension roller 28, which is grounded, and the cleaning blade 27. Due to the action of this electric field, the electrostatic attraction force between the second intermediate transfer belt 20 and the residual toner thereon is reduced. Then, the residual toner and the paper powder on the second intermediate transfer belt 20 are removed by the cleaning roller 29 and the cleaning blade 27. In the case of one-side copying and when no toner image is formed on the second intermediate transfer belt 20, only the cleaning blade 27 is brought into contact with the second intermediate transfer belt 20 to remove the paper powder on the second intermediate transfer belt 20.

According to this embodiment, when there is some residual toner on the second intermediate transfer belt 20, a voltage is applied to the cleaning blade 27 to thereby remove the residual toner and paper powder. In the case of one-side copying and when no residual toner exists on the second intermediate belt 20, no voltage is applied to the cleaning blade 27, which is brought into contact with the second intermediate transfer belt 20 to remove paper powder therefrom. Conventionally, as the means for cleaning the second intermediate transfer belt, there has only been available a single cleaning means, e.g., a cleaning means with a strong cleaning power for toner. Thus, the load on the second intermediate transfer belt has been rather large, resulting in, for example, a premature deterioration of the second intermediate transfer belt.

In contrast, in this embodiment, there are provided, as described above, two cleaning means: the powerful cleaning means for removing toner, and the cleaning means for removing paper powder. Thus, it is possible to perform cleaning in a satisfactory manner. Further, as compared with the prior-art technique, the load on the second intermediate transfer belt 20 is reduced, so that the second intermediate transfer belt 20 is less subject to deterioration.

Further, according to the modification of this embodiment, the cleaning device 25 has two cleaning members: the cleaning blade 27 and the cleaning roller 29. When a strong cleaning power is required as in the case of the removal of residual toner, cleaning is performed with the two cleaning members of the cleaning blade 27 and the cleaning roller 29. When cleaning is to be performed on an object that is relatively easy to remove from the second intermediate transfer belt 20 as in the case of paper powder, cleaning is performed with the cleaning blade 27 alone. In this way, for the removal of residual toner, a plurality of cleaning means are used, thereby making it possible to reliably remove toner.

As described above, in accordance with the present invention, there are provided a plurality of cleaning means for cleaning the second intermediate transfer member. Thus, at least one of these cleaning means may be used as the cleaning means for the case where a toner image is to be transferred solely to the second side of a recording medium, and the other cleaning means may be used as the cleaning means for the case where toner images are to be transferred to both sides of the recording medium. Thus, the cleaning means to be operated when toner images are to be transferred to both sides of a recording medium can be more powerful than the cleaning means to be operated when a toner image is to be transferred solely to the second side of the recording medium.

In this way, cleaning is possible with different powers for different types of image formation on the recording medium, whereby it is possible to perform cleaning reliably, and no undue load is applied to the second intermediate transfer member, thereby making it advantageously possible to elongate the service life of the second intermediate transfer member.

Various modifications will become possible for those skilled in the art after receiving the teachings of the present disclosure without departing from the scope thereof.

What is claimed is:

1. A cleaning device for cleaning a second intermediate transfer member, which is used in an image forming apparatus, the image forming apparatus comprising:

an image bearing member;

a first intermediate transfer member and the second intermediate transfer member whose surfaces are held in contact with each other and caused to make an endless movement while forming a nip therebetween;

a transfer device which transfers toner images to both sides of the recording medium by, in a process of transporting a recording medium held by the nip toward a downstream side of the nip with respect to a direction of the endless movement of the surfaces of the first and second intermediate transfer members, transferring a first toner image, which has been transferred in advance from the image bearing member to the second intermediate transfer member by way of the first intermediate transfer member, to a first surface of the recording medium, and transferring, at the same time, a second toner image, which has been transferred in advance from the image bearing member to the first intermediate transfer member, to a second surface of the recording medium;

a first cleaning unit operated when transferring a toner image solely to the second surface of the recording medium; and a second cleaning unit operated when transferring toner images to both surfaces of the recording medium.

2. A cleaning device as claimed in claim 1, wherein the second cleaning unit has greater cleaning power than the first cleaning unit.

3. A cleaning device as claimed in claim 1, further comprising a plurality of the second cleaning units, one of which is operated when transferring a toner image solely to the first surface of the recording medium.

4. A cleaning device as claimed in claim 1, wherein one of the first and second cleaning units comprises a cleaning member adapted to be brought into contact with the second intermediate transfer member, the cleaning member being formed of one of a blade, a brush, and a roller.

5. An image forming apparatus for forming images on both sides of a recording medium, the image forming apparatus comprising:

an image bearing member;

a first intermediate transfer member and a second intermediate transfer member whose surfaces are held in contact with each other and caused to make an endless movement while forming a nip therebetween;

a transfer device which transfers toner images to the both sides of the recording medium by, in a process of transporting a recording medium held by the nip toward a downstream side of the nip with respect to a direction of the endless movement of the surfaces of the first and second intermediate transfer members, transferring a first toner image, which has been transferred in advance from the image bearing member to the second intermediate transfer member by way of the first intermediate transfer member, to a first surface of the recording medium, and transferring, at the same time, a second toner image, which has been transferred in advance from the image bearing member to the first intermediate transfer member, to a second surface of the recording medium; and a cleaning device for cleaning the second intermediate transfer member, the cleaning device comprising a first cleaning unit operated when transferring a toner image solely to the second surface of the recording medium, and a second cleaning unit operated when transferring toner images to both surfaces of the recording medium.

6. An image forming apparatus as claimed in claim 5, wherein the second cleaning unit has greater cleaning power than the first cleaning unit.

7. An image forming apparatus as claimed in claim 5, wherein the cleaning device comprises a plurality of the second cleaning units, one of which is operated when transferring a toner image solely to the first surface of the recording medium.

8. An image forming apparatus as claimed in claim 5, further comprising a cleaning member adapted to be brought into contact with the second intermediate transfer member, the cleaning member being formed of one of a blade, a brush, and a roller.

* * * * *